US006561453B1

(12) United States Patent
Shinga

(10) Patent No.: US 6,561,453 B1
(45) Date of Patent: May 13, 2003

(54) PAPER ROLL SUPPORTING APPARATUS

(75) Inventor: Takahiro Shinga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/546,620

(22) Filed: Apr. 10, 2000

(30) Foreign Application Priority Data

Apr. 8, 1999 (JP) ..... 11-101389

(51) Int. Cl.[7] ..... B65H 75/00
(52) U.S. Cl. ..... 242/595.1; 242/578.2
(58) Field of Search ..... 242/578, 578.2, 242/596.1, 596.7, 596.8, 393, 129, 595.1

(56) References Cited

U.S. PATENT DOCUMENTS 1,136,577 A * 4/1915 Ahlstrom
1,333,953 A * 3/1920 White
2,679,987 A * 6/1954 Saliba
3,411,734 A * 11/1968 Greenberg et al.
4,176,801 A * 12/1979 Douglas
5,322,234 A * 6/1994 Robert et al.
5,687,928 A * 11/1997 Lassiter
5,875,626 A * 3/1999 Cromartie
6,059,220 A * 5/2000 Lassiter

FOREIGN PATENT DOCUMENTS

DE 1 632 457 12/1951
DE 1 886 375 1/1964
DE 41 23 868 1/1992

* cited by examiner

*Primary Examiner*—William A. Rivera
(74) *Attorney, Agent, or Firm*—Oblon, Spivak, McClelland, Maier & Neustadt, P.C.

(57) ABSTRACT

A paper roll supporting apparatus in which circular cylindrical flange members are tightly fitted to both ends of the paper roll and the outer circumferential surface of the respective flange members are pivotally supported by rotatable bodies. The respective rotatable bodies for pivotally supporting the respective flange members include at least two rollers which are arranged around the flange members, the axis lines of which are parallel with each other. The rollers are provided so as to be rotatably mounted respectively on receiving stands capable of changing the position thereof to coincide with the width of the paper roll. By improving the flange member, the structure of the member can be made simplified, the cost can be reduced, and the ease of setting the paper roll can be improved.

31 Claims, 10 Drawing Sheets

FIGI 10B

PAPER ROLL SUPPORTING APPARATUS

BACKGROUND OF THE INVENTION

1. Field of the Invention

The present invention relates to a paper roll holding or supporting apparatus for being installed in an image forming apparatus having a paper conveying mechanism such as printer, copying machine, facsimile device, etc.

2. Discussion of the Background

Hitherto, when the paper roll is set to the image forming apparatus, the so-called spool type member has been widely used. In this manner, since the paper roll can be supported along the entire width thereof and further the spool can be directly positioned on the side plate of the apparatus main body, an unintentional shaft movement of the paper roll rarely occurs and the ease of conveying the paper roll may be improved.

However, in the large-size copying machine, in particular, a machine capable of handling the copying operation for the AO-size paper, the spool length inevitably turns out to be 1 m and as a result a difficulty in handling the paper roll at the time of setting or removing the paper roll occurs. Therefore, such spool type member is not preferable for a large-size copying machine.

On the other hand, for instance, the published specifications of Japanese Laid-open Utility Model Publication No. 64-43048 and Japanese Published Utility Model Publication No. 7-48598, etc. propose a method of tightly fitting the flange on both sides of the paper roll putting it on the roller-state body. In this manner, since the structure of the roller pair having a flange put thereon is adopted in the apparatus, the flange inevitably turns out to be large-sized. As the result, it is difficult to set the paper roll therein. Namely, the setting of the paper roll to the main body of the apparatus turns out to be difficult because of the large size of the flange and the obstruction caused by the roller.

The above are the troublesome matters to be solved. Furthermore, since the roller is employed, the structure may become rigid and strong. Nevertheless, the position of the rollers has to be readjusted for each of the respective apparatuses, and, excluding the flange, the setting has to be newly made. As the result, performing such adjustments may be troublesome. Such problems have to be also solved. Furthermore, against the requirement of reducing the cost in the recent years, a high-cost roller is used in the apparatus, a drawback which needs to be overcome.

SUMMARY OF THE INVENTION

Heretofore, the background regarding the paper roll supporting apparatus have been described. However, according to such background arts, for instance, disclosed in the background-art documents, e.g., Japanese Laid-open Utility Model Publication No. 64-43048 and Japanese Published Utility Model Publication No. 7-48598, etc., there exists no advantageous functional effect for improving the paper roll supporting apparatus.

The present invention has been made in view of the above-discussed and other problems and solves the above-mentioned defects and troublesome matters of the background art.

In greater detail, a preferred embodiment of the present invention provides a paper roll supporting apparatus in which circular cylindrical flange members are tightly fitted to the both ends of the paper roll and the outer circumferential surface of the respective flange members are pivotally supported by rotatable bodies. The respective rotatable bodies for pivotally supporting the respective flange members comprise at least two rollers which are arranged around the flange members, the axis of which are made parallel with each other. The rollers are provided so as to be rotatably mounted respectively on receiving stands capable of changing the position thereof in coincidence with the width of the paper roll.

The present invention improves the flange in consideration of the defects of the aforementioned background arts and thereby simplifies the structure of the flange. In this manner, the cost thereof can be reduced. In addition, the ease of properly setting the paper roll can be improved considerably.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 7A and 7B are explanatory diagrams for explaining the rocking state of the flange member to the paper roll, wherein FIG. 7A shows a normal state and FIG. 7B shows an abnormal state;

FIGS. 8A and 8B are explanatory diagrams for explaining the operation at the time of setting the flange member to the paper roll, wherein FIG. 8A shows the state of the flange member according to the present invention and FIG. 8B shows the state of the same according to the background art;

FIGS. 9A, 9B and 9C are explanatory diagrams for explaining the operation of the projecting piece attached to the flange portion of the flange member, wherein FIG. 9A shows an ordinary fundamental state, FIG. 9B shows the state of enabling to secure the normal setting state by use of the projecting piece even though the paper roll absorbs the moisture and thereby the end surface thereof is expanded, and FIG. 9C shows the state in which the paper roll having the expanded end surface interferes with the flange portion and thereby the normal state of setting is obstructed;

FIGS. 10A–10D are explanatory diagrams for explaining the structure for rocking the rollers at the receiving stand, wherein FIG. 10A is a perspective view thereof, FIG. 10B is an outlined view showing the concept of the rocking state of the rollers on the edge (i.e. end) surface, and FIG. 10C and 10D show the state of supporting the rollers with the flange member.

DESCRIPTION OF THE PREFERRED EMBODIMENT

Figure 1:
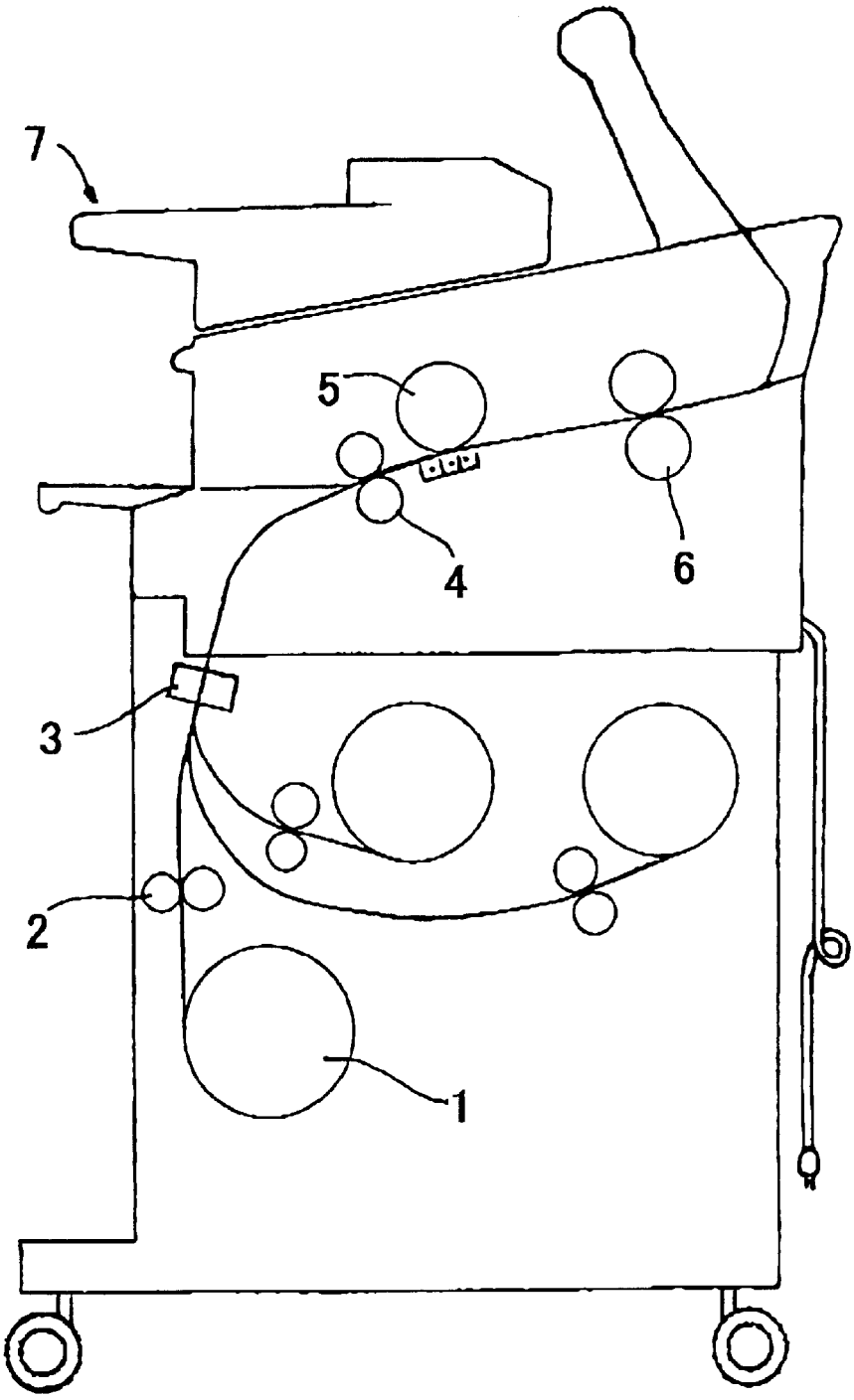
FIG. 1 is a view illustrating the main body of the copying machine equipped with a paper roll supporting apparatus according to the present invention.

In describing the preferred embodiment of the present invention illustrated in the drawings, specific terminology is employed for the sake of clarity. However, the present invention is not intended to be limited to the specific terminology selected and it is to be understood that each specific element includes all technical equivalents which operate in a similar manner.

Figure 2:
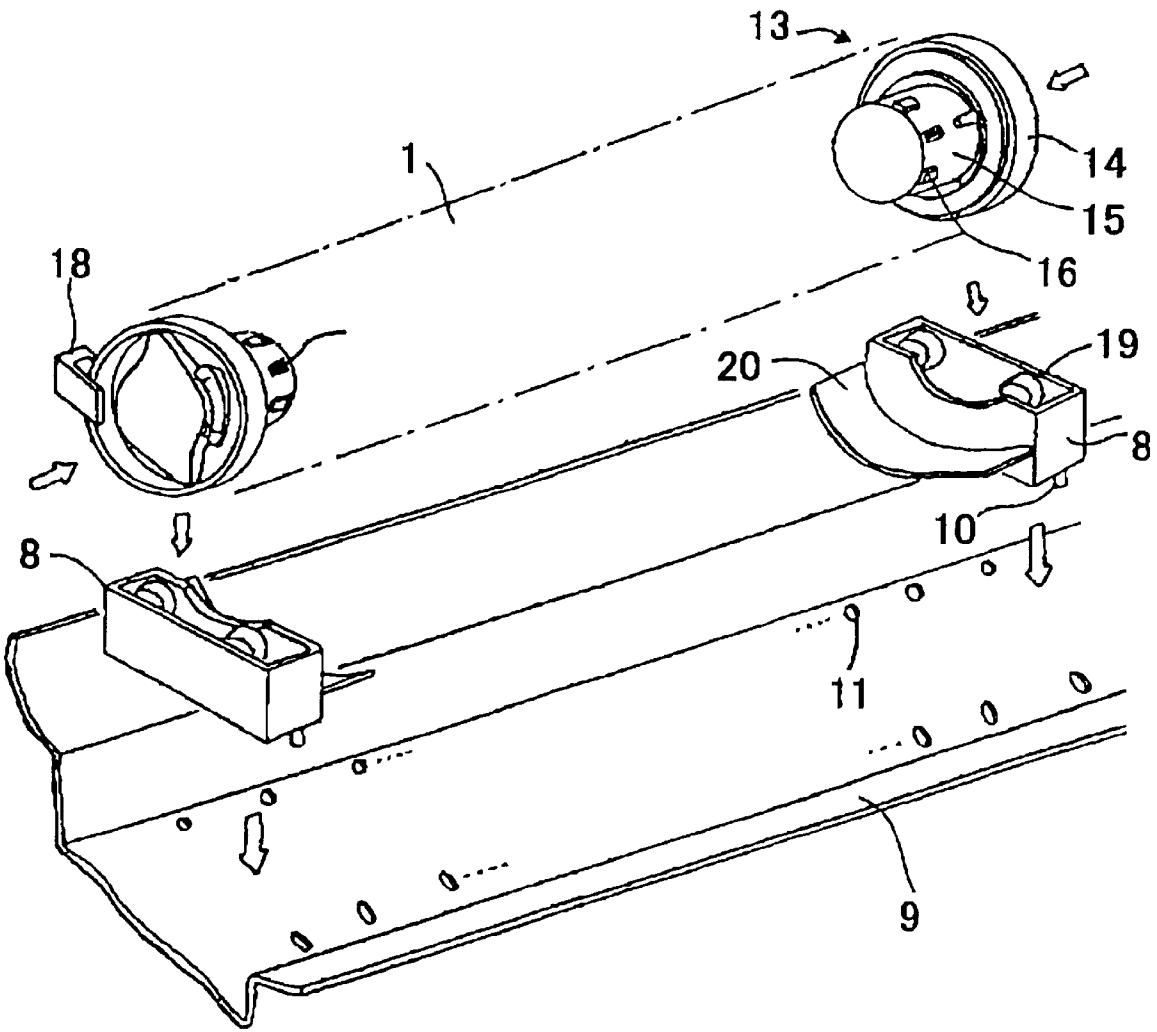
FIG. 2 is an outlined perspective view illustrating the paper roll supporting apparatus according to the present invention.
Figure 3:
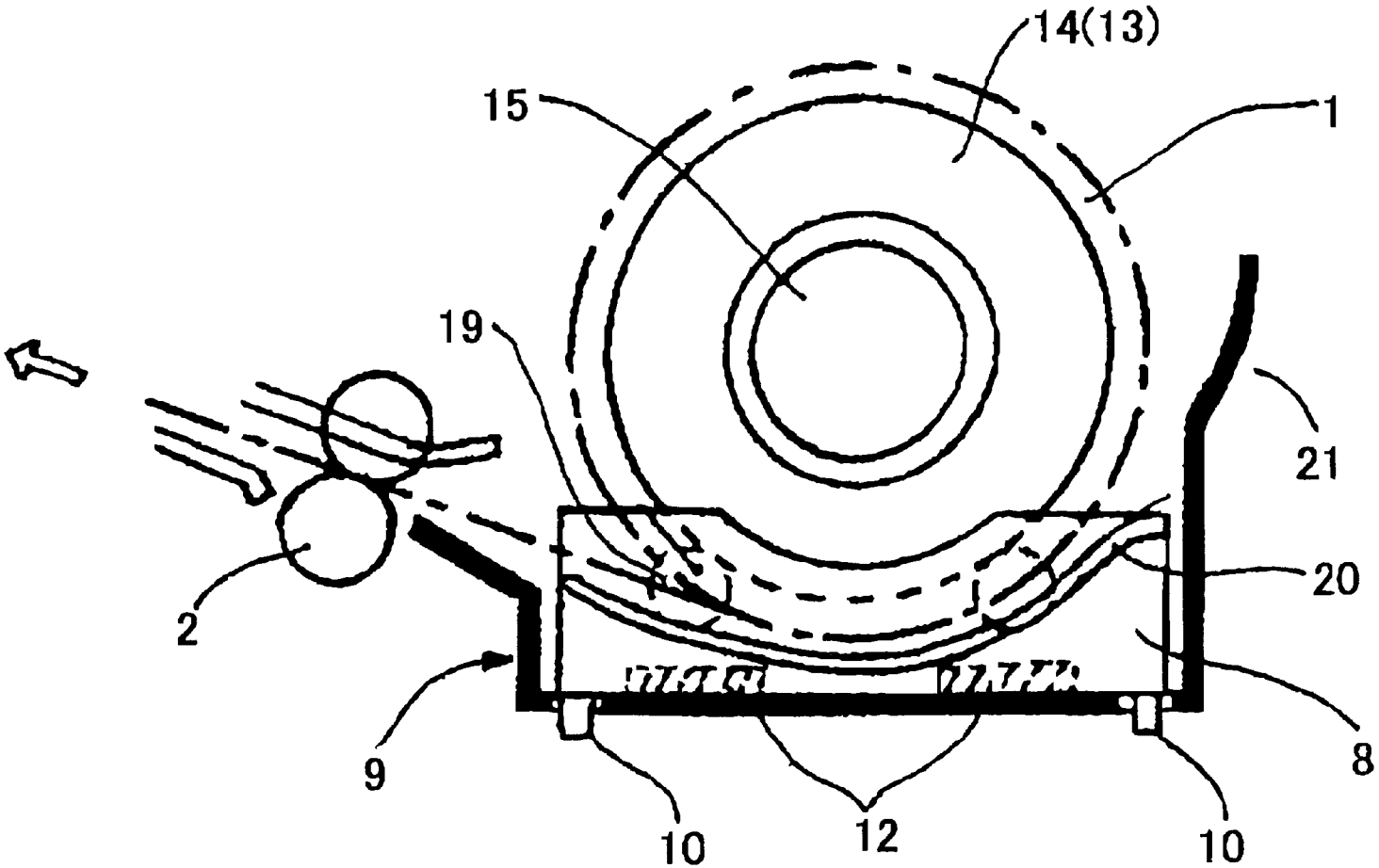
FIG. 3 is a side view illustrating the state of setting the paper roll by use of the paper roll supporting apparatus according to the present invention.

Referring now to the drawings; wherein like reference numerals designate identical or corresponding parts throughout the several views, and more particularly to FIGS. 1 through 3 thereof, there is illustrated a paper roll supporting apparatus of the present invention.

More succinctly, in the embodiment of the present invention, in the paper roll supporting apparatus in which the circular cylindrical flange member is tightly fitted to both ends of the paper roll and the respective flange members are pivotally supported by the rotatable body on the outer circumferential surface thereof, the respective rotatable bodies for pivotally supporting the respective flange members comprise at least two rollers arranged around the flange member, the axis of each being parallel. Those rollers are rotatably arranged on the receiving stand capable of changing the position in coincidence with the width of the paper roll. By adopting such structure as mentioned above, the aforementioned subject matter can be solved.

The above-mentioned flange member is composed of a tightly-fitting portion capable of inserting into the core tube of the paper roll, a flange portion opposing to the end surface of the paper roll, and a pressing piece disposed between the tightly-fitting portion and the flange portion and pressing the inner circumferential surface of the core tube of said paper roll from the inner side of the circumferential surface of the paper roll core tube. If those elements are assembled with a resilient force therebetween, such is preferable. A projecting piece having an outer diameter a little larger than the diameter of the paper roll core tube is provided on the surface opposing to the paper roll of the flange portion. If the flange portion is the one having the different level, it is further effective. Furthermore, it is preferable to set the outermost diameter of the flange member to a value equal to or less than 155 mm.

Moreover, it may be preferable that the above-mentioned receiving stand having at least two rollers provided thereon includes a supporting member enabling the rollers to rockingly move. Furthermore, it may be also preferable to provide a guide piece for guiding the tip end of the paper roll to the paper feeding roller on the vertical surface of the above-mentioned receiving stand at the side of the paper roll.

Details of the embodiment according to the present invention are described herein below, referring to FIGS. 1 through 10. FIG. 1 illustrates the outline of the copying machine main body equipped with the paper roll supporting apparatus according to the present invention. Although the illustration of the above-mentioned copying machine main body is omitted here, a drawer-type paper feeding tray is provided in the main body of the copying machine. In the state of drawing out the paper feeding tray from the main body, the paper roll 1 can be set from the upper or front side (i.e. in FIG. 1, from the left side). The respective paper rolls 1 are respectively drawn out by the feed roller pair 2 and conveyed to the image forming section. The conveying paths of the respective paper roll are merged into one path in front of the paper cutter 3 to a predetermined length required for forming the image.

The paper roll is sent out the image forming section after passing through the paper cutter 3. Synchronization of the same is provided based upon the timing of the image formation by use of the registration roller 4. The toner transferring is performed at the transferring section 5. Thereafter, the thermal fixing operation is done at the fixing section 6, and the fixed copying paper is discharged outside of the copying machine.

On the other hand, the original manuscript document having the image information is conveyed to the document reading-out section 7 and the image information is read out at the document reading-out section 7. On the basis of the read-out image information, the light exposing operation is done on the photosensitive body of the transferring section 5.

FIG. 2 illustrates an exploded view of the assembly illustrating the state of mounting the paper roll to the paper roll setting section of the copying machine main body as shown in FIG. 1. FIG. 3 illustrates the state of setting the paper roll from the side surface.

At the paper roll setting section, a bottom plate 9 for mounting a receiving stand 8 thereon is provided on the bottom area. Several fitting holes 11 are provided on the bottom plate 9. The fitting holes 11 can be tightly fitted to the boss section 10 provided on the lower surface of the receiving stand 8. The reason why the plurality of fitting holes 11 are provided thereon is to enable such to correspond to a plurality of standard sizes. Furthermore, the bottom plate 9 is made of an electrically conductive substance such as metal so as to be attracted by the magnet 12 shown in FIG. 3. In such structure, when the boss section 10 is fitted to the tightly fitting hole 11 of the boss section 10, the receiving stand 8 can be fixed.

On the other hand, a flange member 13 is tightly fitted to the paper roll 1 from the sides of the both paper ends. The flange member 13 is composed of a flange section 14 and a supporting circular cylindrical section 15 of a small diameter is inserted into the paper roll tube and fixed therein. A plurality of ribs 16 forming part the other circular cylindrical having an outer diameter almost equal to the inner diameter of the paper roll tube are arranged at equal intervals on the outer circumferential surface of the supporting circular cylindrical section 15. More specifically, three ribs are arranged on the end portion thereof and three other ribs are arranged on the base portion thereof, both at an equal interval. Due to such structure as mentioned above, shaking or destabilization thereof can be prevented at the time of setting the paper roll. Furthermore, three claw members 17 for pressing the inner wall of the paper tube are projectingly provided at equal intervals between the ribs 16 at the side of the end portion. In such structure, the paper roll and the flange member are fixed to each other by the action of the pressing force exerted therebetween.

Furthermore, at the time of setting the paper roll, the flange section 14 of the one-side flange member 13 is nipped by a position restricting member 18 provided in the paper feeding section. Thereby, the swinging motion thereof on the lateral position can be suppressed.

The position restricting member 18 can be disposed at an appropriate position in the unit. Two pieces of roller 19 are assembled in the interior of the receiving stand 8 so as to arrange rotatably. The flange section 14 is supported by the rollers 19, and thereby the paper roll 1 can be rotatably held in such structure. A guide surface 20 for guiding the paper roll to the feed roller pair 2 is provided on the side surface at the inner side of the receiving stand 8 such that the surfaces thereof are opposed to each other.

By providing such guide surface 20 therein, when the paper roll 1 is gripped by the feed roller pair 2, the end portion of the paper roll which is apt to cause problems such as becoming broken or hooked most frequently can be reliably guided to the feed roller couple 2. On such occasion, regarding a part of the bottom plate 9 or other member, if an elongated surface of the guide surface 20 is provided in addition to the guide surface 20 as shown in FIG. 3, the operability thereof can be further improved. Furthermore, although it is not shown in FIG. 3, if an auxiliary guide of a substantially similar shape as that of the guide surface 20 is provided in the area within the minimum specified standard size of the paper roll 1 in the center area of the bottom plate 9, the ease of operation can be further improved effectively.

Figure 4:
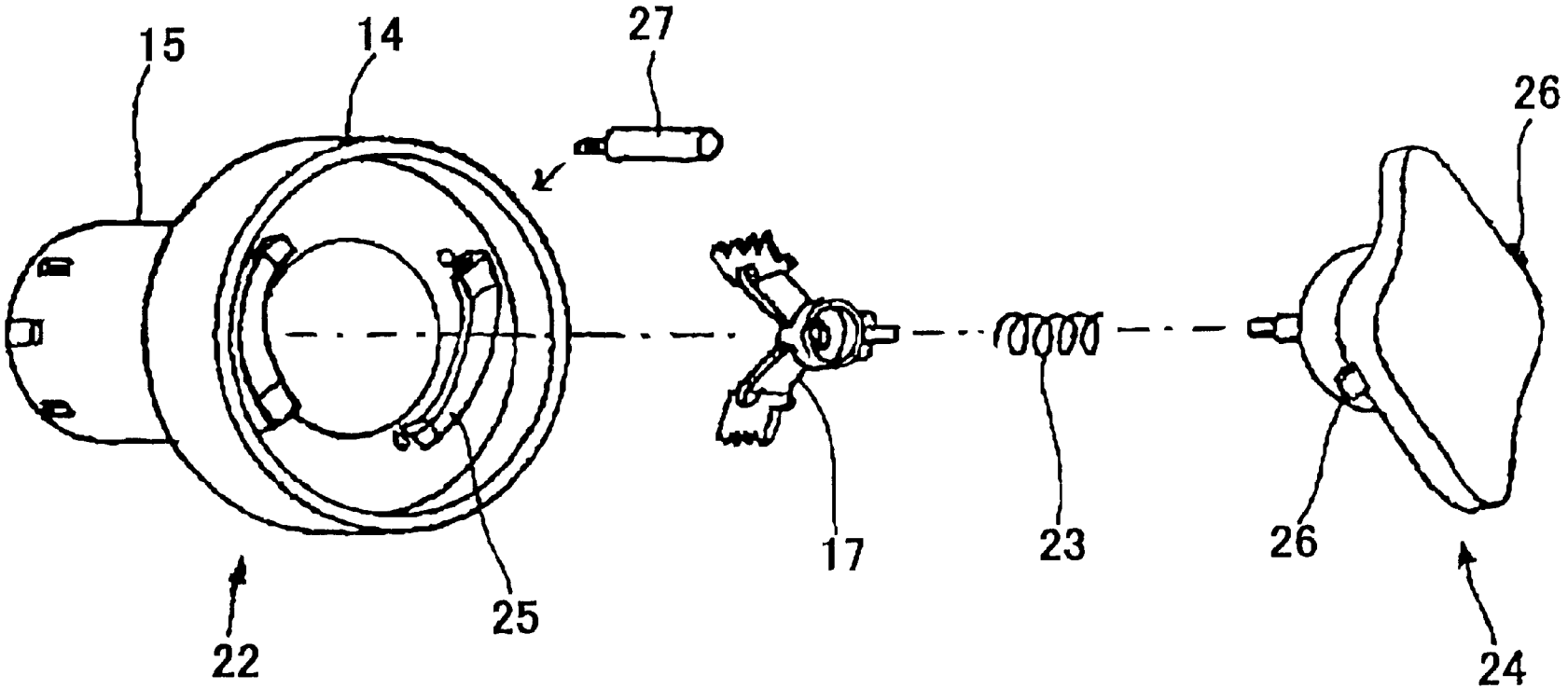
FIG. 4 is an exploded view illustrating a flange member constructing the paper roll supporting apparatus.

FIG. 4 is an exploded assembling view of the flange member 13. Although the outline thereof has been already described, the flange member 13 has a flange main body 22 composed of the flange section 14 and the supporting circular cylindrical section 15. In addition, the flange member 13 is composed of the aforementioned claw member 17 contained in the flange main body 22 and projecting from the outer circumferential surface of the supporting circular cylindrical section 15, a spring 23 for pressing the claw member 17, and a lock member 24 receiving one end of the spring 23 and is provided with a lock/release lever. Engaging guides 25 having a cross section of the letter "L" and formed in the shape of the circular arc are provided on two positions of the inner plane surface of the flange section 14. The engaging guides 25 are employed in order to smoothly change the height. An engaging projection piece 26 provided on the outer circumference of the lock member 24 is engaged with the guide groove formed in the L-letter cross section.

The structural parts as mentioned heretofore are connected to each other in series. The rotating operation of the lock member 24 is converted to the height of the engaging guides 25, and thereby the pushing-in amount of the lock member 24 turns out to be changed.

Figure 5:
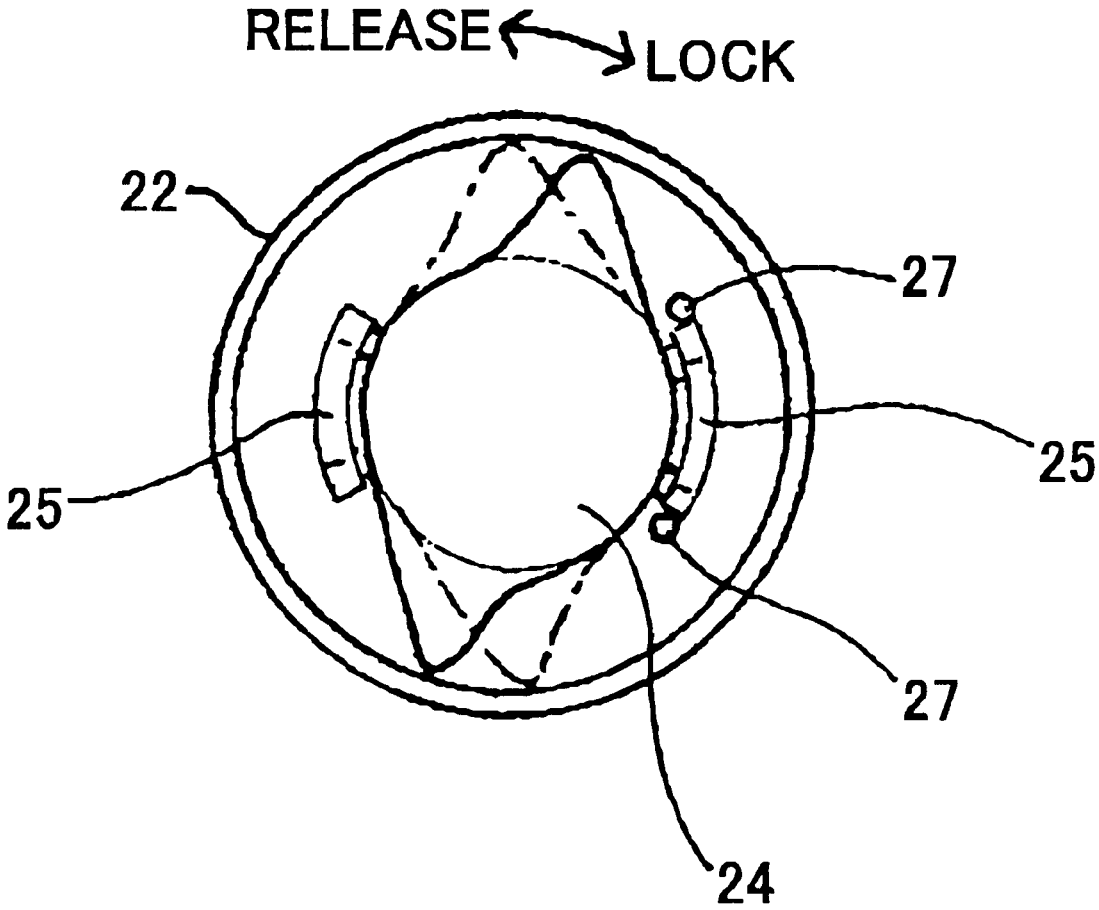
FIG. 5 is an explanatory diagram for explaining the state of tightly locking and releasing of the flange member to and from the paper roll.

In FIG. 5, when the lock member 24 is fully rotated in a clockwise direction, the member 24 is put in the locking state. At this time, the height of the engaging guides 25 engaged with the engaging projection piece 26 becomes its smallest, and the spring 23 is contracted and thereby the pressing force against the claw member 17 may become its greatest value. Namely, by the action of the rotation of the lock member 24, the spring 23 is expanded or contracted. Thereby, a predetermined pressing operation against the claw member 17 can be obtained.

Furthermore, the engaging guide 25 is not inclined and instead becomes horizontal on the lock position. The lock member 24 can maintain the state of directly pressing the spring 23. It may be allowable to provide a pin 27 in order to restrict the operating area of the lock member 24 after assembling the flange member 13. The restruction member is not always limited to the pin-shaped member. If the restriction member is the one capable of restricting the operating area of the lock member, the shape and structure of the restriction member may be optional.

Figure 6:
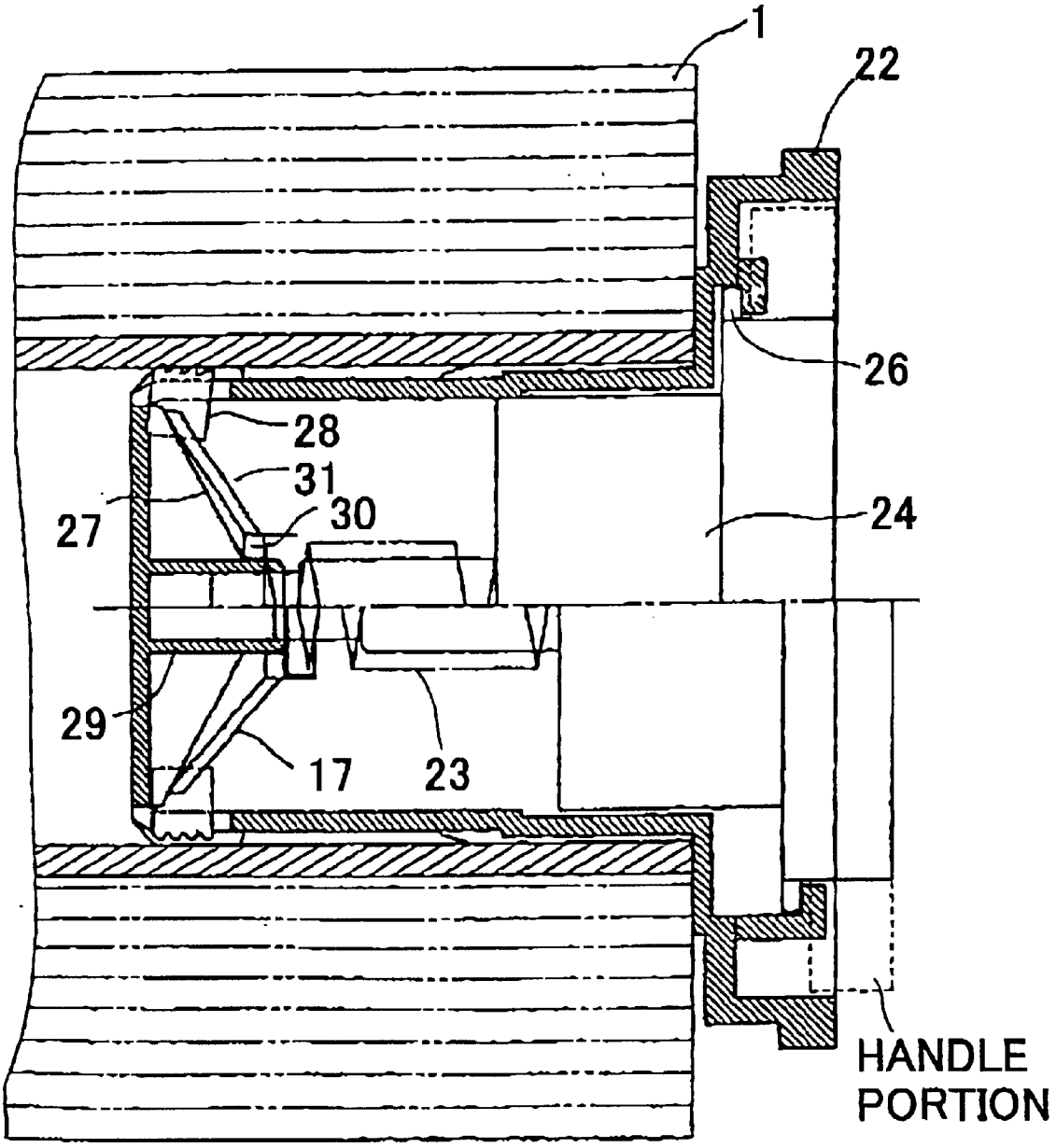
FIG. 6 is an operational cross-sectional view illustrating the operation of the flange member.

FIG. 6 illustrates, in detail, the action of the flange member 13. In FIG. 6, the upper side from the center line represents the locked state, while the lower side therefrom represents the released state. The flange main body 22 has through holes formed on three positions for the claw member 17, and a bag-like structure, the tip end of which is closed. Such structure has a shape keeping the superiority in the strength. Therefore, the structure can sufficiently support the heavy paper roll. Triangle-shaped ribs 27 (in FIG. 4, three ribs corresponding to the number of the claws in the claw members are shown) are respectively formed on the inner circumferential surface of the tip end area thereof. The ribs 27 are two-rows-state ribs expanding in the respective directions in coincidence with the shape of the claw member 17 and provided with the guide grooves.

The tip end claw 28 of the claw member 17 is guided by the guide groove. The guide members in the opening/expanding direction and the height direction at the time of deforming the claw member 17. A boss shaft 29 is formed in the inner-side end surface center area of the flange main body. The boss shaft 29 serves as the operational guide of the claw member 17 at the outer circumferential side, and serves as that of the lock member at the inner circumferential side.

The claw member 17 is constructed with a short circular cylindrical body 30 accommodating a part of the spring 23 and an arm section 31 formed of three pieces, respectively arranged with an equal-angle positioning and having a claw 28 formed at the tip end thereof. The hole corresponding to the boss shaft 29 is formed on the center of the plate section of the short circular cylindrical body 30, and serves as the operational guide.

To explain the operation thereof at the time of locking, when the lock member 24 is rotated and pushed in along the engaging guide 25, the spring 23 is contracted and presses the short circular cylindrical body 30. As a result, the arm 31 is deformed, and thereby the tip end claw is pressed outwardly to the outside. At this time, the inner wall of the paper tube of the paper roll is pressed by the tip-end claw. Since the claw is opened and expanded until the claw is pushed against the inner wall of the paper tube, a reliable setting thereof can be obtained regardless of the tolerance of the inner diameter of the paper tube. Furthermore, by pressing the integrally formed claw member by use of only one spring, a uniform pressurization setting force can be applied to the respective tip end claws without causing any unevenness for each of the respective tip end claws. In such structure, it is possible to suppress backlash due to the biased loading.

FIG. 7 illustrates the normal/abnormal state of the operation at the time of rocking.

Figure 7A:
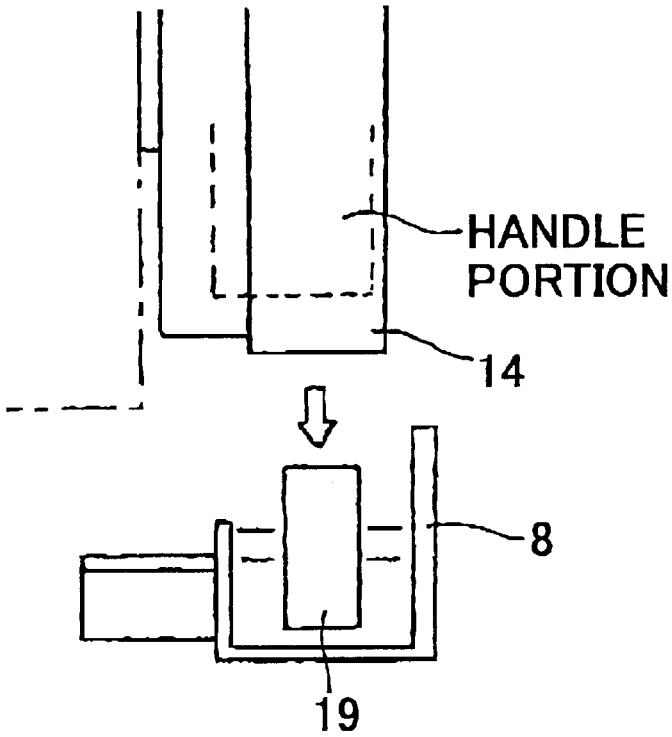
Figure 7B:
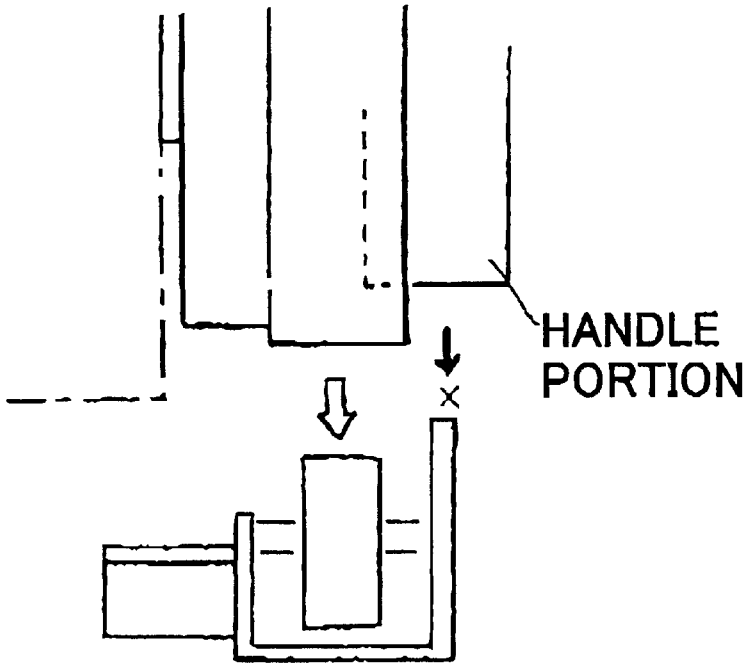

FIG. 7A shows the normal state of the operation, while FIG. 7B shows the abnormal state of the operation. In FIG. 7A, the handle portion of the rock member 24 is accommodated in the flange section 14 and mounted on the rollers 19 of the receiving stand 8. On the contrary, in FIG. 8B, since the rock member 24 is not radially pushed into the normal lock position, the engaging projection piece 26 extends out of the flat surface of the engaging guide 25, and thereby the same is moved back to the release position by the action of the repulsive force due to the spring 23. On this occasion, the above-mentioned handle portion projects from the flange section 14 and interfaces with the side wall at the time of setting the receiving stand 8 as indicated by the black arrow mark. Therefore, a proper setting operation cannot be completed.

FIG. 8 illustrates the setting of the flange member to the paper roll before the time of locking. Regarding the flange member 13 according to the present invention, the diameter of the flange is prescribed to be equal to or less than 155 mm, in particular and preferably to be equal to or less than 140 mm. Almost all of the paper roll used at present throughout the world may be ordinary paper (plain paper), and the total length of the roll of wound paper is almost 150 mm. Searching the outer diameter of the new paper roll before putting on the market, the outer diameter thereof may be in the range of almost 155 mm~175 mm and almost 162 mm in average.

Figure 8A:
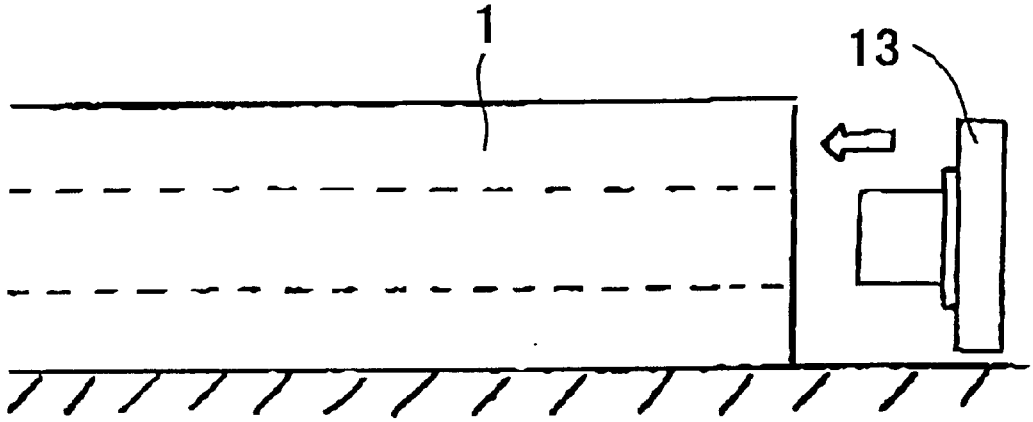

For this reason, as shown in FIG. 8A, the flange diameter of the flange member 13 according to the present invention is generally smaller than the outer diameter of the paper roll 1, and a heavy paper roll of large size can be inserted as is from the lateral direction into the copying machine from the state of putting the paper roll on the desk, etc. Therefore, the structure as mentioned above may be superior in terms of ease of the operation.

Figure 8B:
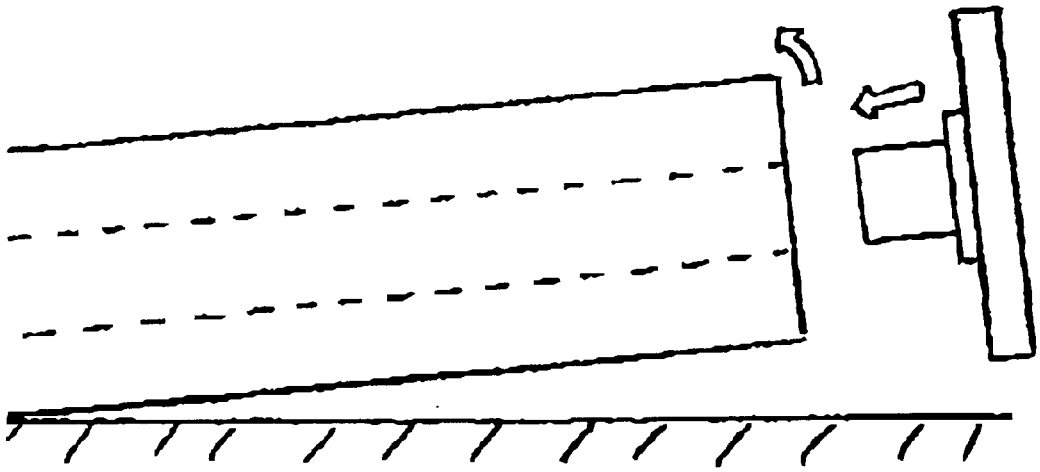

On the contrary, as shown in FIG. 8B, regarding the flange member having a further large diameter, it is necessary to perform the setting operation during lifting up of the paper roll when it is inserted into the copying machine. Therefore, the work required for the setting operation may become considerably difficult. On some occasions, the paper roll used on the half way is exchanged for a new one. However, even on such occasion, regarding the flange member according to the present invention, the diameter of the paper roll is comparatively small or the weight of the paper roll of the diameter reduced at the time of using the paper on the half way may also become reduced. Similarly to the case of FIG. 8B, even in the case of lifting up the paper roll at the time of setting, the amount of lifting up of the paper roll is comparatively small, and thereby an adverse effect on the ease of setting can be largely reduced.

FIG. 9 is a cross-sectional view illustrating the area of the tight fitting between the flange member 13 and the paper roll 1. The flange member 13 is provided with a projecting piece 32 on the surface impinging upon the paper roll. The projecting piece 32 has a diameter little larger than the outer diameter of the paper tube. It may be preferable that the diameter of the projecting piece 32 is of a size such that the end surface of the paper roll can be surely received by the diameter of the projecting piece 32. For instance, the suitable size thereof may be almost equal to "the outer diameter of the paper tube +5 mm~30 mm".

Figure 9A:
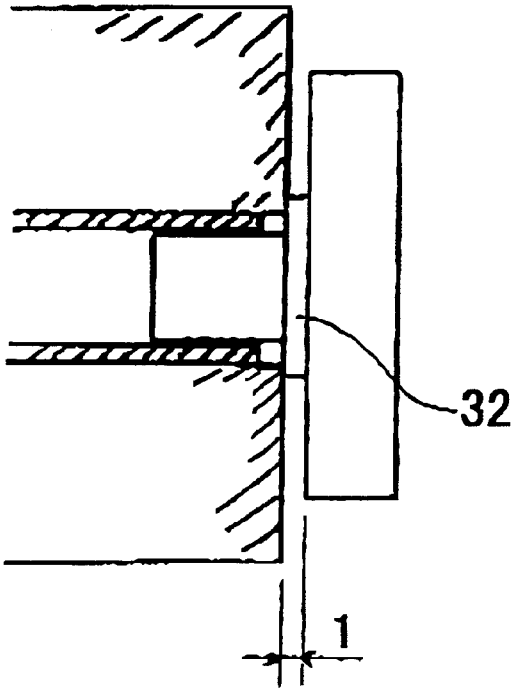

In such structure, the paper width of the paper roll main body part in the longitudinal direction thereof differs from the length of the paper tube. Therefore, even in the case of using the paper roll of short paper tube, the paper setting can be suitably done by causing the projecting piece 32 to directly impinge upon the end surface of the proper roll and thereby the lateral position of the paper roll does not shift at all as shown in FIG. 9A. On the other hand, even in case that the end surface of the paper roll becomes not aligned, the tolerance of the paper setting state may be increased.

Figure 9B:
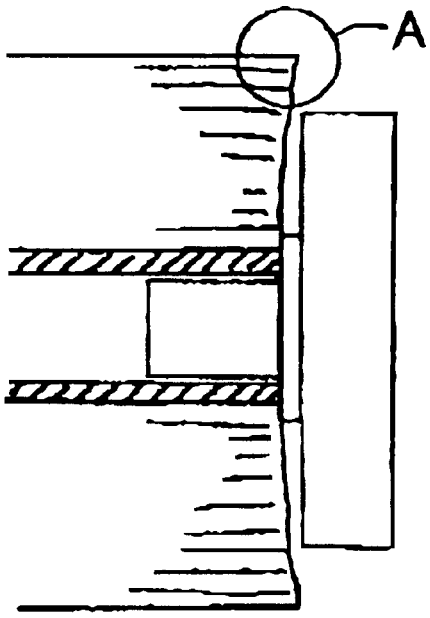
Figure 9C:
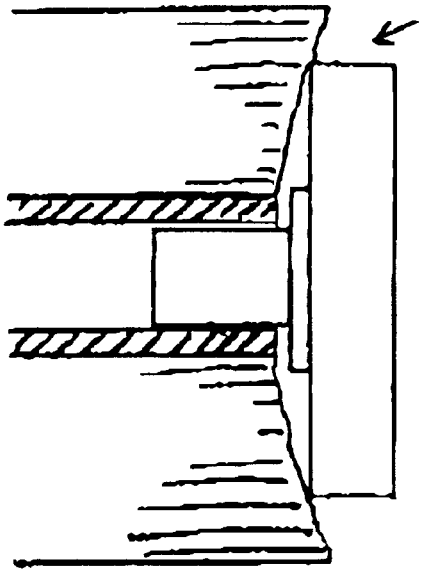

For instance, when the paper is exposed to air, the paper gradually absorbs moisture. In particular, the expansion of paper at the outermost circumferential part of the paper may become most prominent as shown in FIG. 9B. Even on such occasion, since the flange member 13 is provided with the projecting piece 32, it is possible to secure the paper setting state until the expansion of paper searches the difference in level of the flange member. When the paper roll further absorbs the moisture and the state of the paper becomes unsuitable, as shown in FIG. 9C, the end surface of the paper roll previously impinges upon the outer circumferential edge of the flange member 13 instead of the projecting piece 32 of the flange member 13. Therefore, the flange member cannot be fully inserted into the inner part of the flange member. Consequently, the flange member 13 is shifted onto the position of the handle portion as shown in FIG. 7B. In such state, the paper roll cannot be set normally. At this time, a warning can be issued to the user (operator). Here, although the level difference (in FIG. 9A, represented by "1") of the projecting piece 32 is affected by the margin (tolerance) of the apparatus main body, probably, the level difference thereof equal to or less than 3 mm may be suitable.

FIG. 10 illustrates the structure capable of changing the supporting height by use of the rollers 19. As shown in FIG. 10A, the pair of rollers 19 are respectively rotatably supported both ends of the arm 33. A shaft pin 34 pierces (passes through) the center of the arm 33. Both ends of the shaft pin 34 are respectively supported by the side walls of the receiving stand 8 so as to rockingly move the arm 33. In such structure as mentioned above, the rollers 19 at the both ends of the arm 33 rock each other just like a seesaw, and thereby the respective supporting heights can be changed.

Figure 10A:
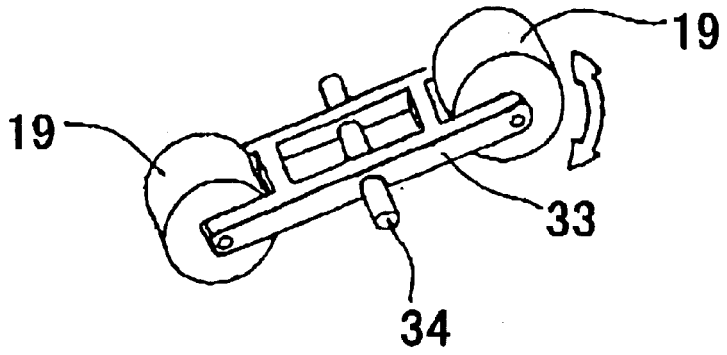
Figure 10A:
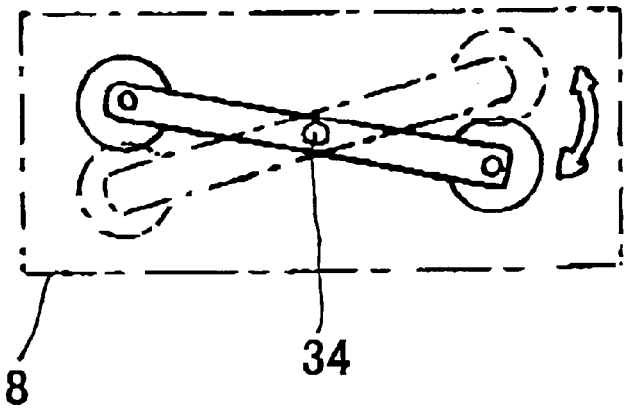
Figure 10C:
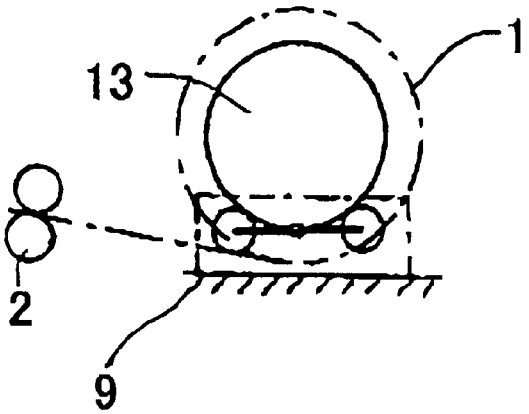
Figure 10D:
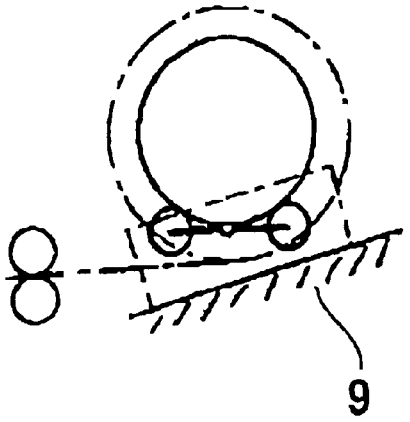

The practical examples of the structure are illustrated in FIG. 10C and FIG. 10D. FIG. 10C shows a general structure having a horizontal bottom plate 9, while FIG. 10D shows another structure having an inclined bottom plate 9. In such state as shown in FIG. 10D, the inclined bottom plate is apt to be necessitated for the inner-side of the paper roll (i.e. in FIG. 1, the right-side of the paper roll) at the time of setting two rolls of paper into a single tray. When the rollers 19 are parallel with the receiving stand 8, the flange member 13 is apt to be dislodged easily in the paper feeding direction. Therefore, as shown in FIG. 10D, by changing the supporting height by use of such rollers 19, a stable state of setting can be created.

As is apparent from the foregoing description, according to the present invention, the respective rotatable bodies for pivotally supporting the respective flange members are composed of at least two rollers arranged around the flange member and having the respective axis lines thereof parallel with one another. Those rollers are rotatably arranged on the receiving stand capable of changing the position to coincide with the width of the paper roll. Consequently, contrary to the pair of rollers provided with the flange member having full width same as that of the paper roll as described in the background art, the structure can be further simplified, the cost thereof can be reduced, and the ease of setting the paper roll can be improved, according to the present invention.

In addition to the above, the present invention further accomplishes the following advantageous functional effects.

The aforementioned flange member comprises the tightly-fitting portion which is capable of being inserted into the core tube of the paper roll, the flange section being opposed to the edge surface of the paper roll, and the pressing piece being disposed between the tightly-fitting portion and the flange section for pressing the inner circumference of the paper roll core tube from the inner side thereof. If such elements are assembled under the influence of the resilient force between each other, when the inner circumference of the paper roll core tube cannot be assuredly pressed by the pressing piece, it becomes impossible to correctly assemble those elements due to the action of the resilient force. Thus an incorrect paper setting can result.

A projecting piece having a diameter a little larger than that of the paper roll core tube is provided on the surface of the flange section opposing to the paper roll. The flange section is the one having different levels. In such structure, even though the length of the paper roll core tube is shorter than the width of the paper roll, the paper setting can be done correctly. Furthermore, even in case that the edge surface of the paper roll may become not aligned due to the moisture absorption, etc., it is possible to have a large tolerance with respect to the fitness or adaptation of the paper setting.

In such aforementioned structure provided with the supporting member capable of rockingly moving the rollers by use of the receiving stand having at lest two rollers carried thereon, the supporting rollers carried thereon, the supporting rollers angle for the flange member corresponding to the paper feeding angle of the paper roll and the holding angle of the receiving stand, and the troublesome problems that the flange member moves over the rollers and become spaced therefrom can be avoided. Furthermore, it may be possible to easily adapt the paper roll supporting apparatus of the present invention to the apparatus of the various different models in which the paper feeding angles of the paper roll differ from each other.

If the guide piece for guiding the tip end of the paper roll to the paper feeding roller is provided on the vertical surface at the paper roll side of the above-mentioned receiving stand, even the end portion of the paper on which the hooking or folding of paper may happen most frequently can be surely guided to the paper feeding section.

While the preferred embodiment of the present invention has been described heretofore, numerous additional modifications and variations of the present invention are possible in light of the above teachings. It is therefore to be understood that within the scope of the appended claims, the present invention may be practiced otherwise than as specifically described herein.

This application claims benefit of priority under 35 U.S.C. §120 to Japanese Patent Application No. 11-101389 filed in the Japanese Patent Office on Apr. 8, 1999, the entire contents of which are incorporated by reference.

What is claimed is as new and is desired to be secured by letters patent of the United States:

1. A paper roll supporting apparatus, which comprises:

circular cylindrical flange members which are tightly fitted to opposite ends of a paper roll, an outer circumferential surface of said respective flange members being rotatably supported by rotatable bodies, wherein:

said respective rotatable bodies for pivotally supporting said respective flange members each comprise at least two rollers which are arranged around said flange members, the axis lines of which are parallel with one another, said rollers are provided so as to be rotatably mounted respectively on receiving stands which are of changeable positions so as to coincide with a width dimension of said paper roll, and a guide piece for guiding the tip end of said paper roll to a feeding roller, said guide piece being located on a vertical surface at a paper roll of said receiving stand.

2. The paper roll supporting apparatus as defined in claim 1, wherein said flange members respectively comprise:

a tight-fitting portion insertable into a core tube of said paper roll so as to be tightly fitted thereto;

a flange portion located opposite an end surface of said paper roll; and a pressing piece disposed between said tight-fitting portion and said flange portion and pressing an inner circumferential surface of the core tube of said paper roll from an inner side of the circumferential surface of said paper roll core tube, wherein said tightly-fitting portion, said flange portion, and said pressing piece are positioned so as to oppose each other while under a resilient force.

3. The paper roll supporting apparatus as defined in claim 2, which comprises a projecting piece having an outer diameter larger than a diameter of said paper roll core tube, said projecting press being provided on a surface opposing to said paper roll of said flange portion; and wherein said flange portion comprises a stepped piece.

4. The paper roll supporting apparatus as defined in claim 3, wherein a maximum outer diameter of said flange member is equal to or less than 155 mm.

5. The paper roll supporting apparatus as defined in claim 4, which comprises a guide piece for guiding an end portion of said paper roll to a feeding roller, said provided on the vertical surface at a paper roll side of said receiving stand.

6. The paper roll supporting apparatus as defined in claim 3, which comprises a guide piece for guiding an end portion of said paper roll to a feeding roller, said guide piece being on a vertical surface of a paper roll side of said receiving stand.

7. The paper roll supporting apparatus as defined in claim 2, wherein a maximum outer diameter of said flange member is equal to or less than 155 mm.

8. The paper roll supporting apparatus as defined in claim 7, which comprises a guide piece for guiding an end portion of said paper roll to a feeding roller, said guide piece being provided on a vertical surface at a paper roll of said receiving stand.

9. The paper roll supporting apparatus as defined in claim 2, which comprise a guide piece for guiding the tip end of said paper roll to a feeding roller, said guide piece being provided on vertical surface at a paper roll side of said receiving stand.

10. The paper roll supporting apparatus as defined in claim 1, wherein a maximum outer diameter of said flange member is equal to or less than 155 mm.

11. The paper roll supporting apparatus as defined in claim 4, which comprises a guide piece for guiding an end portion of said paper roll to a feeding roller, said guide piece being provided on a vertical surface at a paper roll side of said receiving stand.

12. The paper roll supporting apparatus as defined in claim 1, wherein said receiving stand provided with at least two rollers comprises a supporting member for rocking said rollers.

13. The paper roll supporting apparatus as defined in claim 12, wherein a guide piece for guiding the tip end of said paper roll to a feeding roller is provided on the vertical surface at the paper roll side of said receiving stand.

14. A paper roll supporting apparatus comprising:

circular cylindrical flange means tightly fitted to end portions of said paper roll for fixing said paper roll; and a plurality of rotatable body means for pivotally supporting said respective flange means, wherein:

an outer circumferential surface of said respective flange means is rotatably supported by said rotatable body means, said respective rotatable body means comprising at least two rollers which are arranged around said flange means, the axis thereof being made parallel with each other, said rollers are provided so as to be respectively rotatably mounted on receiving stands for changing the position thereof so as to coincide with the width of said paper roll, and a guide piece for guiding the tip end of said paper roll to a feeding roller, said guide piece being located on a vertical surface at a paper roll of said receiving stand.

15. The paper roll supporting apparatus as defined in claim 14, wherein said plurality of flange means respectively comprise:

a tightly-fitting portion for being inserted into the core tube of said paper roll so as to be tightly fitted thereto;

a flange portion opposing to the end surface of said paper roll; and a pressing piece disposed between said tightly-fitting portion and said flange portion and pressing the inner circumferential surface of the core tube of said paper roll from the inner side of the circumferential surface of said paper roll core tube, wherein said tightly-fitting portion, said flange portion, and said pressing piece are positioned so as to oppose one another against a resilient force.

16. The paper roll supporting apparatus as defined in claim 15, which comprises a projecting piece having an outer diameter larger than the diameter of said paper roll core tube, said projecting piece being provided on a surface opposing to said paper roll of said flange portion; and wherein said flange portion comprises a stepped piece.

17. The paper roll supporting apparatus as defined in claim 16, wherein a maximum outer diameter of said flange member is equal to or less than 155 mm.

18. The paper roll supporting apparatus as defined in claim 17, which comprises a guide piece for guiding an end portion of said paper roll to a feeding roller, said guide piece being provided on a vertical surface at a paper roll side of said receiving stand.

19. The paper roll supporting apparatus as defined in claim 16, which comprises a guide piece for guiding the tip end of said paper roll to a feeding roller, said guide piece being provided on a vertical surface at a paper roll side of said receiving stand.

20. The paper roll supporting apparatus as defined in claim 15, wherein a maximum outer diameter of said flange member is equal to or less than 155 mm.

21. The paper roll supporting apparatus as defined in claim 20, which comprises a guide piece for guiding an end portion of said paper roll to a feeding roller, said guide piece being provided on a vertical surface at the paper roll of said receiving stand.

22. The paper roll supporting apparatus as defined in claim 15, which comprises a guide piece for guiding the tip end of said paper roll to a feeding roller, said guide piece being provided on a vertical surface of a paper roll side of said receiving stand.

23. The paper roll supporting apparatus as defined in claim 14, wherein a maximum outer diameter of said flange member is equal to or less than 155 mm.

24. The paper roll supporting apparatus as defined in claim 23, which comprises a guide piece for guiding the tip end of said paper roll to a feeding roller, said guide piece being provided on a vertical surface at a paper roll side of said receiving stand.

25. The paper roll supporting apparatus as defined in claim 14, wherein said receiving stand provided with said at least two rollers comprises a supporting member for rocking said rollers.

26. The paper roll supporting apparatus as defined in claim 25, which comprises a guide piece for guiding an end portion of said paper roll to a feeding roller, said guide piece being provided on a vertical surface at a paper roll side of said receiving stand.

27. A method of supporting a paper roll, which comprises the steps of:

tightly fitting circular cylindrical flange members to respectively end portions of the paper roll;

pivotally supporting an outer circumferential surface of said respective flange members by rotatable bodies, said rotatable bodies comprising at least two rollers which are arranged around said flange members, the axis lines of which are parallel with each other;

rotatably mounting said rollers respectively on receiving stands for changing the position in so as to coincide with said paper roll; and guiding the tip end of said paper roll to a feeding roller.

28. The method of supporting the paper roll as defined in claim 27 which comprises: inserting a tightly-fitting portion into the core tube of said paper roll so as to be tightly fitted thereto;

positioning a flange portion of said tightly fitting portion to oppose to an end surface of said paper roll;

positioning a pressing piece between said tightly-fitting portion and said flange portion and said flange portion; and pressing an inner circumferential surface of the core tube of said paper roll from the inner side of the circumferential surface of said paper roll core tube, said flange portion, and said pressing piece being assembled so as to opposite each other against a resilient force.

29. The method of supporting the paper roll as defined in claim 27 which comprises:

providing a projecting piece having an outer diameter larger than the diameter of said paper roll core tube on a surface opposing to said paper roll of said flange portion; and pressing the end surface portion of said paper roll by use of said projecting piece, wherein said flange portion comprises a stepped piece.

30. A paper roll supporting apparatus, which comprises:

circular cylindrical flange members which are tightly fitted to opposite ends of a paper roll, an outer circumferential surface of said respective flange members being rotatably supported by rotatable bodies, wherein:

said respective rotatable bodies for pivotally supporting said respective flange members each comprise at least two rollers which are arranged around said flange members, the axis lines of which are parallel with one another, said rollers are provided so as to be rotatably mounted respectively on receiving stands which are of changeable positions so as to coincide with a width dimension of said paper roll, and a guide means for guiding the tip end of said paper roll to a feeding roller.

31. A paper roll supporting apparatus comprising:

circular cylindrical flange means tightly fitted to end portions of said paper roll for fixing said paper roll; and a plurality of rotatable body means for pivotally supporting said respective flange means, wherein:

an outer circumferential surface of said respective flange means is rotatably supported by said rotatable body means, said respective rotatable body means comprising at least two rollers which are arranged around said flange means, the axis thereof being made parallel with each other, said rollers are provided so as to be respectively rotatably mounted on receiving stands for changing the position thereof so as to coincide with the width of said paper roll, and a guide means for guiding the tip end of said paper roll to a feeding roller.

* * * * *